US009427116B2

(12) United States Patent
Frederick

(10) Patent No.: US 9,427,116 B2
(45) Date of Patent: Aug. 30, 2016

(54) HAMMOCK TUB ASSEMBLY

(71) Applicant: Benjamin Helmut Frederick, Ashland, OR (US)

(72) Inventor: Benjamin Helmut Frederick, Ashland, OR (US)

( * ) Notice: Subject to any disclaimer, the term of this patent is extended or adjusted under 35 U.S.C. 154(b) by 0 days.

(21) Appl. No.: 14/821,774

(22) Filed: Aug. 9, 2015

(65) Prior Publication Data

US 2016/0037971 A1 Feb. 11, 2016

Related U.S. Application Data

(60) Provisional application No. 62/070,020, filed on Aug. 11, 2014, provisional application No. 62/070,019, filed on Aug. 11, 2014.

(51) Int. Cl.
*A47K 3/06* (2006.01)
*A45F 3/22* (2006.01)

(52) U.S. Cl.
CPC .. *A47K 3/06* (2013.01); *A45F 3/22* (2013.01)

(58) Field of Classification Search
CPC ..... A47K 3/06
USPC ..... 4/538–595
See application file for complete search history.

(56) References Cited

U.S. PATENT DOCUMENTS

RE4,949 E 6/1872 Knowlton
754,217 A 3/1902 Herz
830,837 A * 9/1906 Hurst ..... A47C 27/05 5/216
1,073,435 A * 9/1913 Owsley ..... A47K 3/127 4/572.1
1,726,752 A * 9/1929 Mirkin ..... A47K 3/164 4/551
1,750,698 A * 3/1930 Abbott ..... A47K 3/074 248/94
1,798,080 A * 3/1931 Gola ..... A61H 33/06 4/531
1,867,673 A * 7/1932 McCandless ..... A47K 3/164 4/551
2,491,223 A * 12/1949 Stadlman ..... A47K 3/074 4/572.1
2,507,848 A * 5/1950 Bashaw ..... A47K 3/127 4/572.1
2,581,883 A * 1/1952 Rechler ..... A47K 3/164 4/551
2,641,770 A * 6/1953 Chapin ..... A47K 3/022 135/117
3,004,793 A * 10/1961 Loomis ..... A47D 1/00 297/274
3,112,498 A * 12/1963 Hoffman ..... A47K 3/06 4/585
3,366,978 A * 2/1968 Jones ..... A47K 3/06 4/540

(Continued)

*Primary Examiner* — Lori Baker
(74) *Attorney, Agent, or Firm* — Jerry Haynes Law

(57) ABSTRACT

A hammock tub assembly serves as both a hammock for leisure swinging, sleeping, or resting; and a tub for soaking, hydrotherapy, and pleasure. A suspended non-permeable panel conforms to the shape and weight of the loads. The non-permeable panel is defined by a body portion and a perimeter portion. The body portion supports the solid and liquid loads, conforming to the shapes and weight of each load. The perimeter portion includes fastening points that maintain a fixed position for the body portion for enabling the stretching of the body portion into a generally concave shape. When stretched between the fixed points, the body portion forms a generally concave shape that cradles the solid load and contains the liquid load. The liquid is circulated through a filtering portion. A lighting portion, a sound portion, and a data portion enhance the therapeutic effects.

20 Claims, 3 Drawing Sheets

(56) References Cited

U.S. PATENT DOCUMENTS 3,469,266 A * 9/1969 Hyde ..... A61G 7/0005 4/560.1
3,518,705 A 7/1970 Cudney
3,677,263 A * 7/1972 Allen ..... A61G 7/0005 119/673
3,799,228 A * 3/1974 Crawford ..... A45F 4/00 220/9.2
3,800,336 A * 4/1974 Hoxeng ..... A47K 3/06 4/587
4,057,032 A * 11/1977 Dimitriadis ..... A61D 11/00 119/671
4,068,326 A * 1/1978 Deschler ..... A61G 7/0005 4/534
4,083,328 A * 4/1978 Baker ..... A01K 13/001 119/673
4,602,392 A * 7/1986 Grier ..... A47K 3/024 4/568
4,931,330 A 6/1990 Stier
5,247,712 A * 9/1993 Williams ..... A61G 7/0005 4/538
5,276,926 A * 1/1994 Lopez ..... A47K 3/024 4/568
5,406,655 A * 4/1995 Sahlin ..... A47K 3/064 4/572.1
5,580,448 A 12/1996 Brandreth
5,666,677 A * 9/1997 Crawford ..... A61G 7/0005 4/540
5,722,100 A * 3/1998 Jozwiak ..... A47K 3/127 4/572.1
5,769,535 A 6/1998 Rominger
5,809,588 A * 9/1998 Angelotti ..... A47K 3/064 4/572.1
5,893,341 A 4/1999 Cox
6,088,848 A * 7/2000 Waterlyn ..... A61G 7/0005 4/585
6,112,343 A * 9/2000 Dixon ..... A47K 3/024 4/571.1
6,543,068 B1 * 4/2003 Penninger ..... A47K 3/06 4/585
6,578,209 B2 * 6/2003 Lopes ..... A47K 3/024 4/572.1
6,775,861 B1 * 8/2004 Devereaux ..... A47K 3/024 4/538
6,988,467 B1 * 1/2006 Smith ..... A01K 13/001 119/673
7,032,259 B1 * 4/2006 Kilion ..... A47K 3/064 220/629
7,107,937 B1 * 9/2006 Anderson ..... A01K 13/001 119/665
7,921,812 B1 * 4/2011 Carrillo ..... A01K 13/001 119/602
8,069,821 B1 * 12/2011 Green ..... A01K 13/001 119/671
8,695,129 B2 * 4/2014 Williams ..... A47K 3/06 4/585
8,720,380 B1 * 5/2014 Skirbe ..... A01K 13/001 119/600
9,049,968 B2 * 6/2015 Ellison ..... A47K 3/064
9,055,847 B1 * 6/2015 Flannery ..... A47K 3/064
9,066,632 B2 * 6/2015 Millerd ..... A47K 3/02
9,192,817 B2 * 11/2015 Frolov ..... A63B 35/00
2003/0037369 A1 * 2/2003 Maynard ..... A47C 17/84 4/496
2010/0212084 A1 * 8/2010 Gibson ..... A47K 3/06 4/585
2011/0083613 A1 * 4/2011 Redick ..... A01K 13/001 119/671
2011/0095540 A1 4/2011 Jackson
2012/0017364 A1 * 1/2012 Mayaud ..... A63B 69/125 4/494
2012/0312821 A1 * 12/2012 Matson ..... F16N 31/00 220/573

* cited by examiner

HAMMOCK TUB ASSEMBLY

CROSS REFERENCE OF RELATED APPLICATIONS

This application claims the benefit of U.S. provisional application No. 62/070,019, filed Aug. 11, 2014 entitled Fusion Hammock Hot Tub System, and U.S. provisional application No. 62/070,020, filed Aug. 11, 2014 entitled Fusion Hammock Hot Tub, which provisional applications are incorporated by reference herein in their entirety.

FIELD OF THE INVENTION

The present invention relates generally to a hammock tub assembly that combines a hammock and a hot tub. More so, the present invention relates to a hammock tub assembly that provides a non-permeable panel that stretches between fixed points, and conforms to the shape and weight of a solid load and a liquid load to form a snug, concave shape used for swinging and resting; while also containing a liquid for soaking and hydrotherapy.

BACKGROUND OF THE INVENTION

The invention will now be described, by way of example, with reference to the accompanying drawings, in which:

It is known in the art that a hammock is a sling made of fabric, rope, or netting, suspended between two points, used for swinging, sleeping, or resting. The hammock ideally consists of one or more cloth panels, or a woven network of twine or thin rope stretched with ropes between two firm anchor points such as trees or posts. The hammock is often seen as symbol of summer, leisure, relaxation and simple, easy living.

It is also known that a hot tub is a large tub or small pool full of heated water used for hydrotherapy, bathing, and relaxation. Hot tubs often have powerful jets for massage purposes. Water pumps, heaters, filtration devices, and textured surface form major components of a hot tub.

Typically, hammocks are not designed for water, though some can be washed or left in the weather. The material of hammocks, in most cases, is very porous and designs are not considerate of holding a few hundred pounds of liquid plus an individual or multiple people. Furthermore, hammocks do not always nestle the load comfortable within a concave shape. A user may have a tendency to roll off while lying in the hammock—especially heavier users.

Typically, tubs are ridged, heavy, and bulky. Often, due to their ridged design traditional bathtubs use more water for a person or object to be fully submerged. Consequently, traditional tub designs do not allow for the occupant to fully stretch or lay down without needing to bend one's knees. Prior art of bathing tubs do not pack or ship as compact.

It is common for hot tubs to use a large volume of water. Generally, the water is circulated through filters and the PH levels are maintained with chlorine and/or salts or other processes. These traditional hot tubs do not have an appeal to all people as the circulated water is often too alkaline or full of chemicals due to the chlorine, which some people's skin reacts to. Some people have been recommended not to expose their bodies to chlorine what so ever, while others simply don't find hot tubs appealing due to the underling fact that the water has had other people in it and would prefer fresh water rather then used water.

Other proposals have involved hammocks or hot tubs. The problem with these relaxation tools is that they do not provide the benefits of comfortable lounging provided by a hammock, and the benefits of hot water circulation provided by a hot tub. The traditional hammock also does not provide a snug, concave fit for a user. Also, the hot tub is not always comfortable, such as a hammock can be. Even though the above cited hammocks and hot tubs meet some of the needs of the market, a hammock tub assembly that provides the functionality of both a hammock for leisure swinging, sleeping, or resting; and a tub for soaking, hydrotherapy, and pleasure; while also creating a snug, concave envelope to nestle in, is still desired.

SUMMARY

Illustrative embodiments of the disclosure are generally directed to a hammock tub assembly that serves as both a hammock for leisure swinging, sleeping, or resting; and a tub for soaking, hydrotherapy, and pleasure. The functionality of combining a hammock and a tub forms a synergy that creates a whole that is greater than the separate hammock and tub.

The hammock tub assembly, hereafter, "assembly", serves as both a hammock for leisure swinging, sleeping, or resting; and a tub for soaking, hydrotherapy, and pleasure. A suspended non-permeable panel conforms to the shape and weight of the loads, and stretches between fixed points to form a snug, concave shape for secure retention of a user and a liquid.

The non-permeable panel is defined by a body portion and a perimeter portion. The body portion supports the solid and liquid loads, conforming to the shapes and weight of each load. The perimeter portion includes fastening points that maintain a fixed position for the body portion for enabling the stretching of the body portion into a generally concave shape. When stretched between the fixed points, the body portion forms a generally concave shape that cradles the solid load and contains the liquid load. The liquid is circulated through a filtering portion. A lighting portion, a sound portion, and a data portion enhance the therapeutic effects.

A semi-rigid member integrates into the perimeter portion to help maintain the body portion in a generally concave shape when stretched, and also to help prevent spillage of the liquid out of the concave shape. The assembly further comprises eclectic ancillary components that enhance the relaxation qualities of the invention. In this manner, the assembly may simultaneously serve as a hammock and a tub.

The non-permeable panel is configured to be flexible so as to stretch between a plurality of fixed points. When stretched, the non-permeable panel forms a generally concave shape. The concave shape is efficacious for supporting the solid load and retaining the liquid load inside the non-permeable panel. The non-permeable panel can be solid or transparent.

The generally elongated dimensions and flexible material composition of the non-permeable panel enable formation of the concave shape. In one possible embodiment, the non-permeable panel has a rectangular shape, and the material composition is a sealed acrylic, a clear synthetic or natural material, or the mixture thereof.

The perimeter portion of the non-permeable panel includes a plurality of fastening points for detachably attaching to a corresponding fixed point. In one embodiment, a fastening member, such as a rope may join the fastening point to the fixed point. The non-permeable panel forms a curvature at the edges when the fastening points are attached to the fixed points. This peripheral curvature further articulates formation of the concave shape for the non-permeable panel.

The non-permeable panel can swing laterally when supported at two fastening points. Though, in other embodiments, more than two fastening points are attached to the fixed points, so that the non-permeable panel does not swing. In yet another embodiment, the body portion of the non-permeable panel engages a ground surface while still stretched from the fastening points. In any case, the non-permeable panel operates, at least in part, substantially the same as a hammock. In one embodiment, the assembly is configured to support a solid load, such as a person, for swinging, sleeping, or resting. The weight of the solid load further delineates the concave shape of the non-permeable panel.

In some embodiments, a semi-rigid member integrates into the perimeter portion of the non-permeable panel. The semi-rigid member helps maintain the body portion in a generally concave shape when stretched, and also to help prevent spillage of the liquid out of the concave shape. In one embodiment, the semi-rigid member is an elongated rope or thick cable that is sewn/stitched into the perimeter portion of the non-permeable panel.

The assembly is also configured to support a liquid load for enabling soaking, swimming, and receiving hydrotherapy while lying on the non-permeable panel. In addition to the weight of the solid load, the weight of the liquid load further delineates the concave shape of the non-permeable panel. Furthermore, the assembly is configured not only to fill the non-permeable panel with a liquid, but also to manipulate the liquid so as to provide hot tub functions.

In one embodiment, the liquid may include water. The liquid may be pumped at a high flow rate into the body portion, within the confines of the perimeter portion. The liquid may be drained from the body portion and discarded or recirculated. The liquid may be conditioned and/or cleaned by filtering and dispensing chemicals therein, as known in the art. For these liquid pumping functions, a liquid circulation apparatus may be used to communicate directly with the non-permeable panel.

A mobile portion, such as wheels, enables portability of the liquid circulation apparatus. In one embodiment, the liquid circulation apparatus may include a portable pump that stores, pumps, and recirculates a liquid, such as water. The liquid circulation apparatus further includes a filtering portion to filter and apply chemicals to the liquid.

The liquid circulation apparatus includes an inlet tube that carries the liquid into the concave shape of the non-permeable panel. The inlet tube may hang over the semi-rigid member to fill the concave shape of the body portion. The liquid circulation apparatus further includes an outlet tube that carries the liquid out of the non-permeable panel for discharge or recirculation. A discharge aperture in the body portion of the non-permeable panel enables passage of the liquid from the non-permeable panel to the outlet tube.

The liquid circulation apparatus is configured to pump the liquid at a high flow rate, so as to create a jet effect in the non-permeable panel. A power source, such as a rechargeable battery, powers the liquid circulation apparatus. However, other possibilities may include, without limitation, a convection heat, a heat loop, or a manual pump. In any case, the non-permeable panel, in conjunction with the liquid circulation apparatus, operates, at least in part, substantially the same as a tub. Further, the liquid circulation apparatus may operatively connect to a heating portion that is used for heating the liquid. In this manner, a hot tub experience is possible inside the non-permeable panel.

In some embodiments, the assembly provides eclectic functions, beyond the circulation of the liquid to and from the non-permeable panel. In one embodiment, a lighting portion illuminates the area around the non-permeable panel with a variety of colors and lighting patterns. In another embodiment, a sound portion includes speakers, radios, MP3 players, and the like for providing music, radio, and soothing acoustics in the area of the non-permeable panel. In some embodiments, a data portion, such as a USB port, enables connectivity to the Internet and storage/retrieval of data. In this manner, the relaxation and functionality of the hammock and tub functions are enhanced.

One objective of the present invention is to provide a hammock tub assembly that simultaneously provides the advantages of a hammock and a hot tub.

Another objective is to provide a bath where one can easily fully stretch out and all the while with the hydrotherapy.

Another objective is to increase water efficiency; as the enveloping nature of the hammock tub assembly requires less water be used per bath.

Another objective is to store water within the confines of the non-permeable panel.

Another objective is to provide an improved collapsible, fully portable hammock which can safely carry a user.

Another objective is to provide a hot tub that provides soaking and hydrotherapy.

Another objective is to provide a hammock and a hot tub fabricated form the same flexible non-permeable panel.

Yet another objective is to provide a non-permeable panel that is configured to form a concave shape when stretched and when a load is applied.

Yet another objective is to provide hot, filtered water to the non-permeable panel.

Yet another objective is to regulate the temperature of the liquid being pumped into the non-permeable panel.

Yet another objective is to provide illumination, sound, and data transmission/storage while operating the assembly.

Yet another objective is to power the assembly with substantially renewable energy.

Yet another objective is to enable mobility of the liquid circulation apparatus with a mobility portion.

Yet another objective is to provide an inexpensive to manufacture hammock and hot tub.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 1:
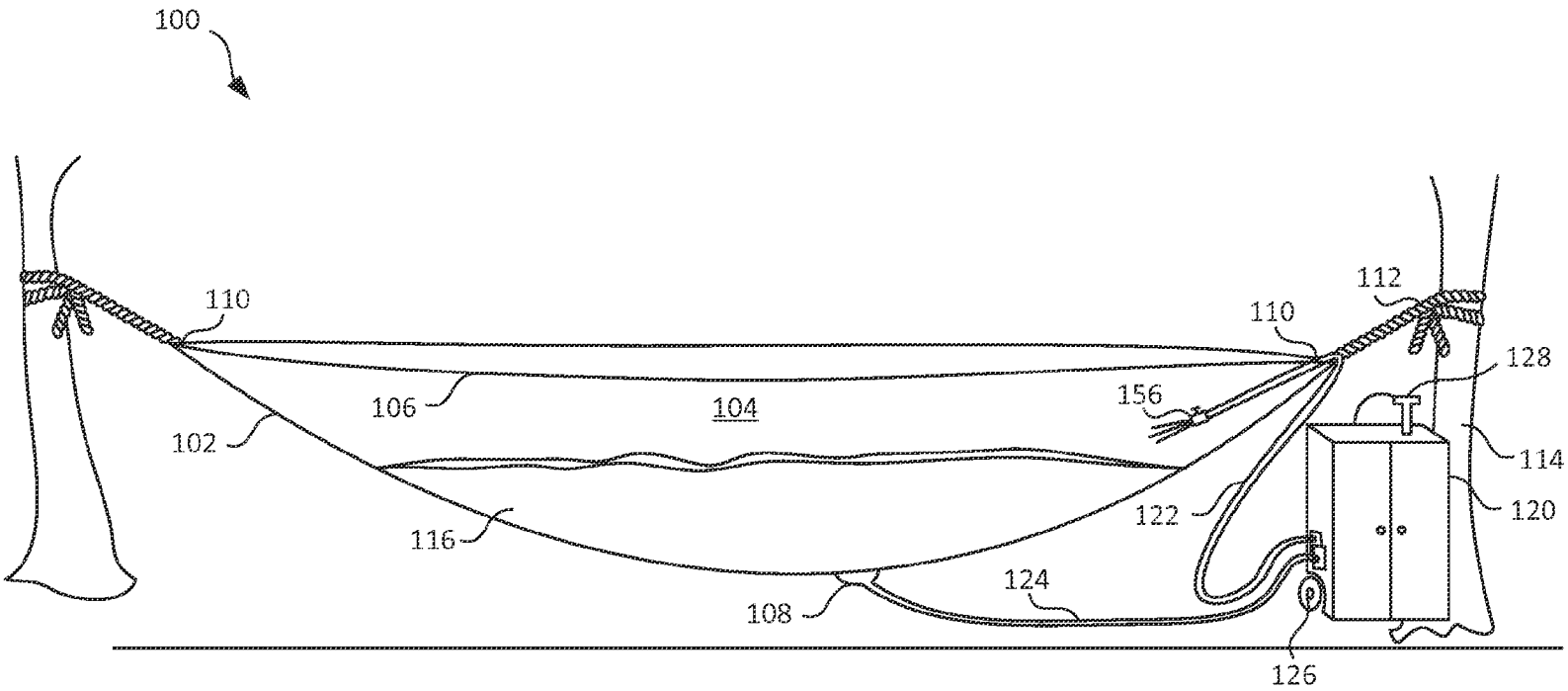
FIG. 1 illustrates a perspective view of an exemplary hammock tub assembly filled with a liquid load through an exemplary liquid circulation apparatus, in accordance with an embodiment of the present invention.
Figure 2:
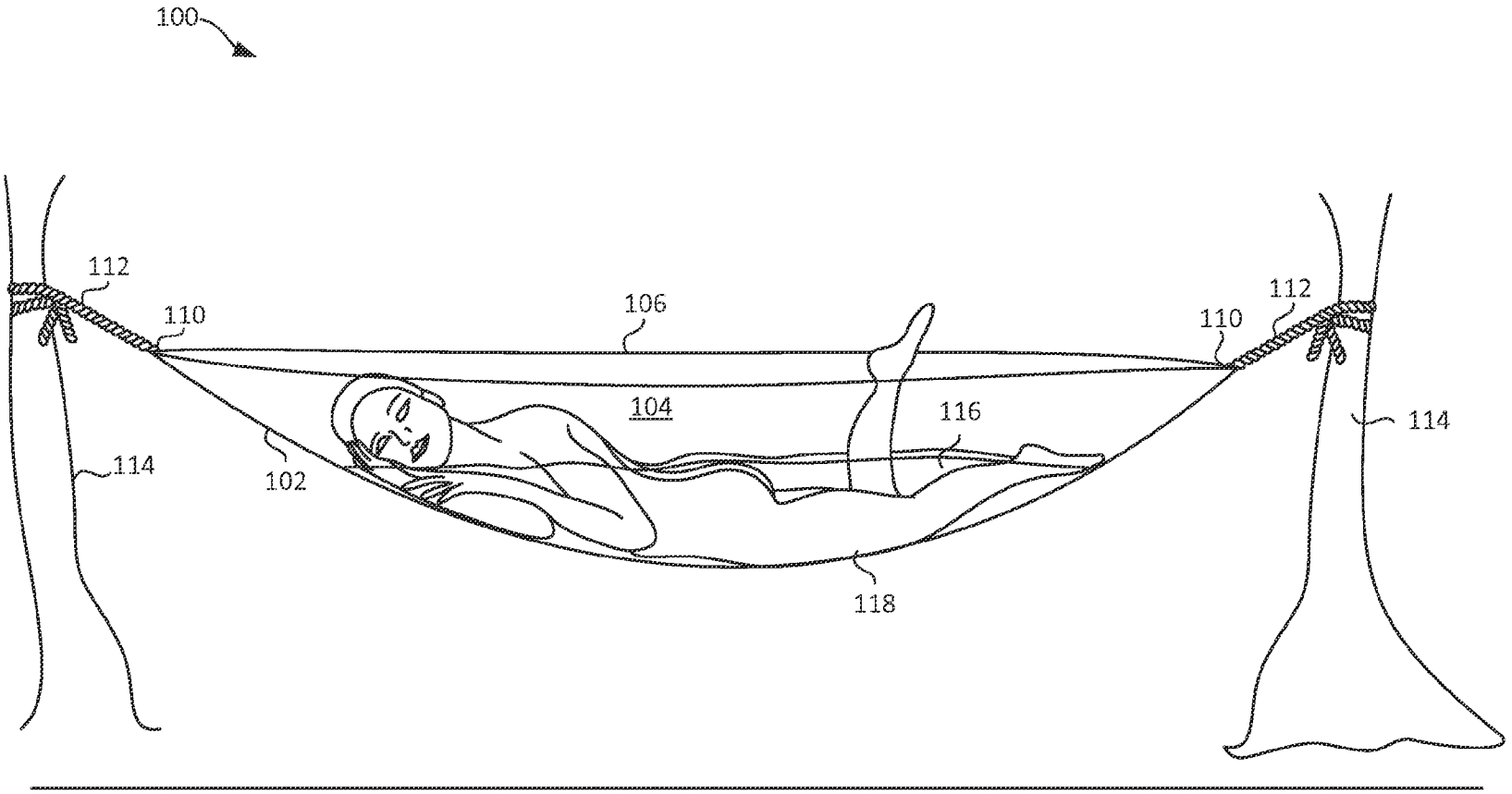
FIG. 2 illustrates a perspective view of the hammock tub assembly supporting an exemplary solid load, in accordance with an embodiment of the present invention.
Figure 3:
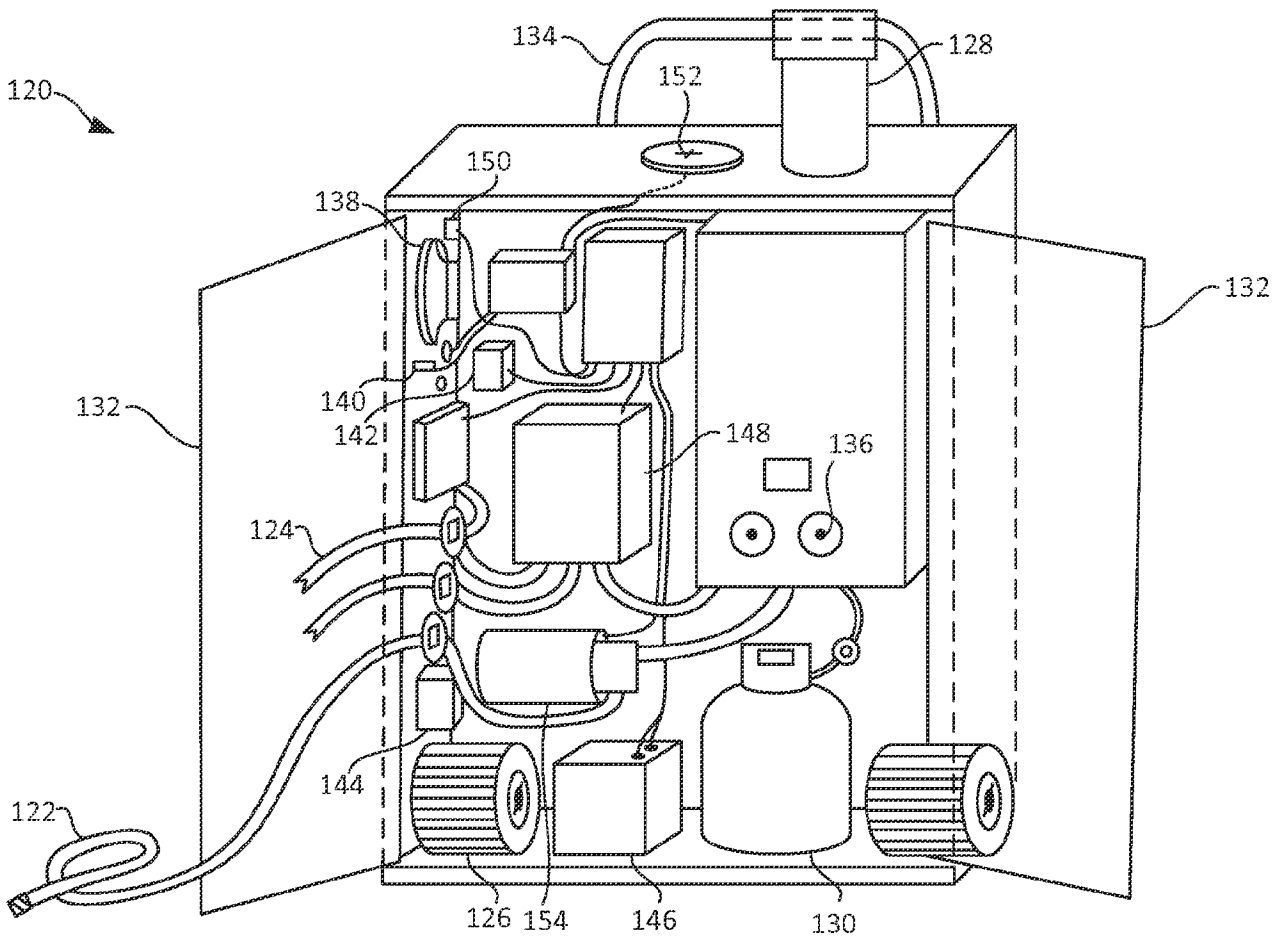
FIG. 3 illustrates a perspective view of the liquid circulation apparatus with the doors opened showing the ancillary components, in accordance with an embodiment of the present invention.

A hammock tub assembly 100 is referenced in FIGS. 1-3. The hammock tub assembly 100 is a dual function relaxation invention that provides the benefits of both a hammock and a tub. In one embodiment, the hammock tub assembly 100 forms a hammock configuration to enable leisure swinging, sleeping, or resting. The hammock configuration may be moved to a desired location and stretched between a plurality of fixed points 114 to enable leisure swinging, sleeping, or resting. In another embodiment, the assembly 100 forms a tub configuration that is configured to enable containment of a liquid for soaking, hydrotherapy, and bathing.

The hammock tub assembly 100 includes a suspended, non-permeable panel 102 that stretches between fixed points 114, and conforms to the supported shapes and weight of a solid load 118 and a liquid load 116 to form a snug, concave shape for secure retention of a user and a liquid. For example, the hammock tub assembly 100 includes a non-permeable panel 102 that is suspended from two trees, or from a single point and such as a frame or beam. The concave shape also serves to securely retain the liquid within the boundaries of the non-permeable panel 102. The non-permeable panel 102 described above may also be used as a portable tub liner in many different surfaces, sand, snow, earth, or other form.

The functionality of combining a hammock and a tub forms a synergy that creates a whole that is greater than a separate hammock and tub. For example, a user may swing on the hammock, while simultaneously soaking in a jet, hot water bath. Further, a user may sit, lie on the back or sides, stand, or kneel on the assembly 100, whether the liquid is present or not. In one possible embodiment, the liquid may be circulated through a filtering portion 144 for cleaning and conditioning while a lighting portion 142, a sound portion 138, and a data portion 140 further enhance the relaxation and therapeutic effects provided by the hammock tub assembly 100.

As referenced in FIG. 1, the hammock tub assembly 100, hereafter, "assembly 100" is configured to support the weight of a solid load 118 and/or a liquid load 116 while also conforming to the weight and shape of the loads. The solid load 118 may include, without limitation, a person, animal, plant, or inanimate object lying on the hammock configuration. The liquid load 116 may include a volume of water that fills the tub configuration. To achieve this dual function of comfortable support for a solid load 118 and containment of a liquid load 116, the assembly 100 utilizes a non-permeable panel 102.

Turning now to FIG. 2, the non-permeable panel 102 is sufficiently flexible, so as to conform to the shape and weight of the loads 116, 118. The non-permeable panel 102 is defined by a body portion 104 and a perimeter portion 106. The body portion 104 of the non-permeable panel 102 supports the solid load 118 and liquid load 116. The body portion 104 at least partially conforms to the shapes and weight of each load 116, 118. The body portion 104 forms a generally concave shape when stretched out and also when the loads 116, 118 are contained therein.

In one embodiment, the non-permeable panel 102 is fabricated from a sealed, acrylic membrane. In another embodiment, the non-permeable panel 102 is a waterproof or water resistant strong fabric. Other possible materials include vinyl coated fabric, awning, cotton, acrylic or other which has a tight weave, or similar canvas material. Membrane materials with UV resistance, or UV resistance coating may also be used with the non-permeable panel 102.

In some embodiments, the non-permeable panel 102 has a transparent membrane that forms a window for viewing through the non-permeable panel 102. In yet another embodiment, the non-permeable panel 102 has an uneven texture configured to inhibit slippage. In this manner, a user can more easily climb in and out of the concave shaped body portion 104, even when the liquid creates slippage along the surface of the body portion 104.

Those skilled in the art will recognize that a window enables a user to appreciate light and color coming through while bathing. Further, if the user is wearing swimming a mask, a snorkel, or goggles, the user may appreciate looking through to read, enjoy different media, interact with others, or receive a massage or therapy. Large sections or the whole non-permeable panel 102 may be made of a clear material which allows for observing the bather, children, or marine life.

Looking back at FIG. 1, the body portion 104 is configured to be flexible so as to stretch between a plurality of fixed points 114. When stretched, the body portion 104 forms a generally concave shape. The concave shape is efficacious for supporting the solid load 118 and retaining the liquid load 116 inside the non-permeable panel 102. The generally elongated dimensions and flexible material composition of the non-permeable panel 102 enable formation of the concave shape.

In one possible embodiment, the non-permeable panel 102 has a rectangular shape, and the material composition is a sealed acrylic, a clear synthetic material, or the mixture thereof. Though, there are embodiments where the non-permeable panel 102 is semi-permeable. This semi-permeable configuration may be because of cotton duck canvas or other materials used to fasten the non-permeable panel 102. The semi-permeable configuration can dampen the material surface causing cooling through evaporation.

The perimeter portion 106 includes a plurality of fastening points 110. The fastening points 110 are configured to maintain a fixed position on the edges of the perimeter portion 106 for enabling the stretching of the body portion 104 into a generally concave shape. The fastening points 110 detachably attach to a plurality of fixed points 114, so that the body portion 104 may be stretched between the fixed points 114.

The non-permeable panel 102 forms a curvature at the edges of the perimeter portion 106 when the fastening points 110 are attached to the fixed points 114. This peripheral curvature further articulates formation of the concave shape for the body portion 104. Thus, when the body portion 104 is stretched between a plurality of fixed points 114, the body portion 104 forms a generally concave shape that is efficacious for comfortably cradling the solid load 118 and containing the liquid load 116 with minimal spillage.

The non-permeable panel 102 can swing laterally, sag, and bounce when supported from multiple fastening points 110. Though, in other embodiments, more than two fastening points 110 are attached to the fixed points 114, so that the non-permeable panel 102 does not swing. In yet another embodiment, the body portion 104 of the non-permeable panel 102 engages a ground surface while still stretched from the fastening points 110. In any case, the non-permeable panel 102 operates, at least in part, substantially the same as a hammock known in the art. In one alternative embodiment, the non-permeable panel 102 serves as a bath or pond liner.

In one example illustrated in FIG. 2, two opposing trees, walls, or posts serve as secure fixed points 114. Heavy-duty hammock stands can also be used to suspend the non-permeable panel 102 from the fastening points 110. The non-permeable panel 102 can swing to and fro or be fixed in position with additional fastening points 110 beyond the one or two fixed points 114 required for suspension. As with traditional hammocks the lowest part of the non-permeable panel 102 may rub against, sit or rest upon the earth, floor or part of an incorporated platform below. These suspension options allow for greater stability and help to distribute the weight, partially supported by a bottom surface may require less load on the fastening points 110.

The fastening points 110 may include, without limitation, loops, reinforced rings, grommets, webbing loops, and formed arcs. The fixed points 114 may include a pair of trees, a building structure, and an object. In one embodiment, a fastening member 112, such as a rope may join each fastening point 110 to a corresponding fixed point 114. The fastening member 112 may include, without limitation, a rope, a bungee cord, and a tie rod.

In one example of the perimeter portion 106 being manipulated to form the concave shape for the body portion 104, the non-permeable panel 102 has an elongated, rectangular shape with two long ends and two short ends. Approximately 1' of the non-permeable membrane on the short sides are folded over, forming a center arch. Formation of this center arch allows the long sides to form a triangle that is approximately 1-3" shorter than the center arch. This folded manipulation allows the body portion 104 to more effectively retain the loads 116, 118 while still keeping the perimeter portion 106 raised.

Bonding agents and/or stitching with appropriate strong thread may be used to secure this fold in place, leaving an opening or hem of adequate space to let the fastening member 112 pass through. For example, this opening in the perimeter portion 106 can form a channel for a line or rope to go through for securing to the fixed points 114. A wooden or other framework can also pass through the opening and include fasteners for securing to fixed points 114.

Alternatively a large rectangle of the above the non-permeable panel 102 can be reinforced similar to the fold over method discussed above. Grommets or webbing loops may be included at the perimeter portion 106 and adequately spaced along the shorter sides of the rectangle material. Ropes or lines may also be fastened accordingly with different lengths to the fastening points 110 point to allow for a desired depth and shape of the non-permeable panel 102.

In some embodiments, a semi-rigid member (not shown) integrates into the perimeter portion 106 of the non-permeable panel 102. The semi-rigid member is efficacious for maintaining the concave shape of the non-permeable panel 102, and helping to restrict spillage of the liquid outside of the concave shaped body portion 104, over the perimeter portion 106. In one embodiment, the semi-rigid member is an elongated rope or thick cable that is sewn/stitched into the perimeter portion 106 of the non-permeable panel 102. Though the semi-rigid member may include any elongated component that stiffens the edge of the perimeter portion 106.

In one alternative embodiment, the non-permeable panel 102 integrates with at least one ancillary panel (not shown). The at least one ancillary panel is configured to overlay one or both sides of the non-permeable panel 102 in a coplanar disposition. The ancillary panel enable attachment of a component to the non-permeable membrane. The ancillary panel may be sealed with the non-permeable panel 102, or have an opening to install, adjust or position the ancillary objects between the non-permeable panel 102 and the ancillary panel.

Various ancillary objects may be incorporated into the ancillary panel or between the ancillary panel and the non-permeable panel 102. Though, these ancillary objects could also be attached to the underside or inside of the non-permeable panel 102 without requiring the ancillary panel. The ancillary objects may include, without limitation, flexible or rigid windows, heating pads, pillows, padding, cup holders, magnets, mesh layers, massage gadgets, structural components, padding, insulation, and inflatable sections.

In another exemplary use of the ancillary panel, jet nozzles pass through the non-permeable panel 102. The jet nozzles direct the liquid to flow at high flow rates detachably attach to clips on the ancillary panel. The ancillary panel is flexible in substantially the same way as the non-permeable panel 102, so as to form the generally concave shape and conform to the weight and shape of the solid and liquid load 116*s*. In one embodiment, the ancillary panel may be porous and may easily peel off the non-permeable panel 102.

The non-permeable panel 102 and/or the ancillary panel may also have recesses for positioning the jet nozzles and other hammock features. The recesses in the non-permeable panel 102 and/or the ancillary panel can take the shape of any practical shape or design from the weight of the liquid and/or assisted shapes with inflated sections or ridged framing. The non-permeable panel 102 may have multiple size or shape options by adjusting tension on lift points. In yet another embodiment, mosquito netting, or other enclosures can be canopied over the non-permeable panel 102 with an entry way to regulate access.

In addition to the solid load 118 discussed above, the non-permeable panel 102 is also configured to support a liquid load 116 for enabling soaking, swimming, and receiving hydrotherapy. Similar to the weight of the solid load 118, the weight of the liquid load 116 delineates the concave shape of the non-permeable panel 102. In one alternative embodiment, two non-permeable panels 102 and/or an ancillary layer form an insulated layer for the liquid. For example, water can also be filled in the area between two non-permeable panels 102 to form a water bed. The water between the two layers may be regulated to provide a warm bed in a temperature controlled bed or vessel.

The assembly 100 not only fills the concave shape of the non-permeable panel 102 with a liquid, but also manipulates the liquid, so as to provide known hot tub functions. In one embodiment, the liquid may include water. The liquid may be pumped at a high flow rate into the body portion 104, and within the confines of the perimeter portion 106. The liquid may be drained from the body portion 104 and discarded or recirculated. The liquid may be conditioned and/or cleaned by filtering and dispensing chemicals therein, as known in the art. For these functions, a liquid circulation apparatus 120 may be used to communicate directly with the non-permeable panel 102.

The liquid circulation apparatus 120 is configured to pump the liquid at an adjustable flow rate, so as to create various jet effects for a user positioned within the concave shape of the non-permeable panel 102. A mobile portion 126, such as wheels, enables portability of the liquid circulation apparatus 120. In one embodiment, the liquid circulation apparatus 120 may include a portable pump 154 that stores, pumps, and recirculates a liquid, such as water. The liquid circulation apparatus 120 further includes a filtering portion 144 to filter and apply chemicals to the liquid. The filtering portion 144 may include a water filter and a chemical dispensing device.

As shown in FIG. 1, the liquid circulation apparatus 120 includes an inlet tube 122 that carries the liquid into the concave shape of the non-permeable panel 102. The inlet tube 122 may hang over the semi-rigid member to fill the concave shape of the body portion 104. In one embodiment, the terminus of the inlet tube 122 includes a hot water easy snap fitting 156 for mating accessories to the inlet tube 122. The accessories may include a high flow nozzle or a spout. However, in one alternative embodiment, the inlet tube 122 may be replaced by general plumbing fixtures known in the art for carrying the liquid to the non-permeable panel 102, rather than the liquid circulation apparatus 120. The plumbing fixtures may include a sink, a garden hose, and a showerhead or other accessories.

The liquid circulation apparatus 120 further includes an outlet tube 124 that carries the liquid out of the non-permeable panel 102 for general discharge, storage, or recirculation. A discharge aperture 108 forms in the body portion 104 of the non-permeable panel 102. The discharge aperture 108 enables passage of the liquid from the non-permeable panel 102 to the outlet tube 124.

In one embodiment, the outlet tube 124 is efficacious for draining used liquid into the earth with a drain line gravity feed. In another embodiment, the outlet tube 124 carries the liquid to a drain, tub, or toilet for disposal. This flexible drainage capacity empties the assembly 100 facilitates cleaning and rinsing for future use of the assembly 100. In one alternative embodiment, the liquid may be stored and treated for multiple uses in the liquid circulation apparatus 120, or a separate container.

FIG. 3 illustrates that the liquid circulation apparatus 120 can be portable. A mobility portion 126, such as a pair of wheels enables facilitated mobility. A handle 134 enables control of the liquid circulation apparatus 120. A door 132 regulates access to the interior cavity of the liquid circulation apparatus 120. A power source 146, such as a rechargeable battery, powers the liquid circulation apparatus 120. A solar panel may be used to recharge the rechargeable battery. An A/C power source 150 146 may also recharge the rechargeable battery. A D/C charger 148 may also be used for powering and recharging, as needed. In this manner, renewable energy forms a substantial part of recharging the power source 146.

Further, the liquid circulation apparatus 120 may operatively connect to a heating portion 130 that is used for heating the liquid. In this manner, a hot tub experience is possible inside the confines of the non-permeable panel 102. The heating portion 130 may include a natural gas heater. In one embodiment, a propane gas tank fits into a cavity of the liquid circulation apparatus 120. In one embodiment, an exhaust 128 releases excess heat from the liquid and the liquid circulation apparatus 120. A thermostat 136 also regulates the temperature of the liquid flowing into the non-permeable panel 102.

In one alternative embodiment, the liquid circulation apparatus 120 and the heating portion 130 work in conjunction to create a recirculating shower, or warmer for a heat exchanger. The heating capacity of the liquid circulation apparatus 120 enables the formation of heated water or ease to plug into an RV to run the warm water systems in RV, boat, home, food truck or other vehicle.

The assembly 100 further comprises ancillary components that enhance the relaxation qualities. In one embodiment shown in FIG. 3, a lighting portion 142 illuminates the area around the non-permeable panel 102 with a variety of colors and lighting patterns. The lighting portion 142 may include a lamp, a halogen bulb, and a floodlight that emits various colors and pattern in proximity to the non-permeable panel 102. The illumination can be decorative or functional.

In another embodiment, a sound portion 138 emits sound in proximity to the assembly 100. The sound portion 138 may include, without limitation, speakers, radios, MP3 players, and the like. The sound portion 138 provides voice recordings, music, radio, and soothing acoustics to enhance the experience of the assembly 100. An antenna 152 may be used to receive radio signals for playing a radio or other wireless data transfers known in the art.

In some embodiments, a data portion 140 enables data to be transmitted and stored from the assembly 100. The data portion 140 integrates into the liquid circulation apparatus 120. The data portion 140 may include, without limitation, a USB port. The data portion 140 enables connectivity to the Internet and storage/retrieval of data. In this manner, the assembly 100 may be enjoyed while maintaining connectivity to wireless networks and data storage devices.

In one alternative use of the assembly 100, modern bathroom designs with or without a tub, may install the assembly 100 at adequate fixed points 114 in the bathroom walls. In another possible use, newly designed or refurbished bathrooms can incorporate proper engineering and construction so mounting fixed points 114 on the walls will be sufficient to suspend the non-permeable panel 102 and plumbing fixtures for supplying the liquid to the non-permeable panel 102. Thus, the assembly 100 may be used in any location, room of a house or building, roof, porch or patio as used in present day hammocks, bathtubs, pools, or ponds.

In yet another alternative embodiment, the non-permeable panel 102 may be configured to integrate with the stretched fabric of a trampoline. The stretched fabric has a central opening. The non-permeable panel 102 stretches across the opening. While in this disposition with the stretched fabric of the trampoline, the body portion 104 forms an acute concave shape, that when filed with the liquid, creates a splashing effect while a user bounces on the stretched fabric of the trampoline.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A hammock tub assembly, the assembly comprising:

a non-permeable panel, the non-permeable panel defined by a body portion and a perimeter portion, the body portion having a discharge aperture, the body portion further having a non-permeable membrane, the body portion configured to form a generally concave shape when stretched, the perimeter portion having a plurality of fastening points, the plurality of fastening points configured to maintain a fixed position for enabling the stretching of the body portion into the generally concave shape;

a semi-rigid member, the semi-rigid member defined by an elongated shape, the semi-rigid member configured to integrate along the length of the perimeter portion, the semi-rigid portion further configured to help maintain the generally concave shape of the body portion when stretched;

a liquid circulation apparatus, the liquid circulation apparatus configured to enable pumping of a liquid to and from the body portion of the non-permeable panel;

an inlet tube, the inlet tube configured to join with the liquid circulation apparatus, the inlet tube further configured to enable carrying the liquid from the liquid circulation apparatus to the body portion of the non-permeable panel, wherein the liquid is pumped into the generally concave shape of the body portion;

an outlet tube, the outlet tube configured to join with the discharge aperture of the body portion, the outlet tube further configured to enable carrying the liquid away from the body portion;

a heating portion, the heating portion configured to enable heating the liquid;

a filtering portion, the filtering portion configured to enable at least partial cleaning of the liquid;

a lighting portion, the lighting portion configured to enable emitting an illumination proximal to the non-permeable panel; and a sound portion, the sound portion configured to enable emitting a sound proximal to the non-permeable panel.

2. The assembly of claim 1, wherein the non-permeable panel is a sealed, acrylic membrane.

3. The assembly of claim 1, wherein the non-permeable panel is a transparent membrane.

4. The assembly of claim 1, wherein the non-permeable panel has an uneven texture configured to inhibit slippage.

5. The assembly of claim 1, further including at least one ancillary panel configured to overlay the non-permeable panel in a coplanar disposition, the at least one ancillary panel further configured to enable attachment of a component to the non-permeable membrane.

6. The assembly of claim 1, wherein the plurality of fastening points are configured to join with a plurality of fixed points.

7. The assembly of claim 6, further including a fastening member configured to join the plurality of fastening points to the plurality of fixed points.

8. The assembly of claim 1, wherein the semi-rigid member is a rope that is sewn into the perimeter portion of the non-permeable panel.

9. The assembly of claim 1, wherein the semi-rigid member is configured to help restrict spillage of the liquid out of the generally concave shape of the body portion.

10. The assembly of claim 1, wherein the liquid circulation apparatus is a pump.

11. The assembly of claim 1, wherein the liquid circulation apparatus further includes a mobile portion configured to facilitate mobility of the liquid circulation apparatus.

12. The assembly of claim 1, further including a data portion configured to enable transmission and storage of data.

13. The assembly of claim 1, wherein the heating portion is a natural gas heater.

14. The assembly of claim 1, wherein the heating portion comprises an exhaust configured to release excess heat from the liquid.

15. The assembly of claim 1, wherein the heating portion comprises a thermostat configured to regulate the temperature of the liquid.

16. The assembly of claim 1, wherein the lighting portion is a light bulb.

17. The assembly of claim 1, wherein the sound portion is a speaker.

18. The assembly of claim 1, wherein the filtering portion comprises a water filter and a chemical dispersing device.

19. The assembly of claim 1, further including a power source, the power source configured to provide power to at least one of the following: the liquid circulation apparatus, the lighting portion, the sound portion, the heating portion, and the filtering portion.

20. A hammock tub assembly, the assembly comprising:

a non-permeable panel, the non-permeable panel defined by a body portion and a perimeter portion, the body portion having a discharge aperture, the body portion further having a non-permeable membrane, the body portion configured to form a generally concave shape when stretched, the perimeter portion having a plurality of fastening points, the plurality of fastening points configured to maintain a fixed position for enabling the stretching of the body portion into the generally concave shape;

at least one ancillary panel, the at least one ancillary panel configured to overlay the non-permeable panel in a coplanar disposition, the at least one ancillary panel further configured to enable attachment of a component to the non-permeable membrane;

a semi-rigid member, the semi-rigid member defined by an elongated shape, the semi-rigid member configured to integrate along the length of the perimeter portion, the semi-rigid portion further configured to help maintain the generally concave shape of the body portion when stretched;

a liquid circulation apparatus, the liquid circulation apparatus configured to enable pumping of a liquid to and from the body portion of the non-permeable panel, the liquid circulation apparatus further comprising a mobile portion, the mobile portion configured to facilitate mobility of the liquid circulation apparatus;

an inlet tube, the inlet tube configured to join with the liquid circulation apparatus, the inlet tube further configured to enable carrying the liquid from the liquid circulation apparatus to the body portion of the non-permeable panel, wherein the liquid is pumped into the generally concave shape of the body portion;

an outlet tube, the outlet tube configured to join with the discharge aperture of the body portion, the outlet tube further configured to enable carrying the liquid away from the body portion;

a heating portion, the heating portion configured to enable heating the liquid;

a filtering portion, the filtering portion configured to enable at least partial cleaning of the liquid;

a lighting portion, the lighting portion configured to enable emitting an illumination proximal to the non-permeable panel;

a sound portion, the sound portion configured to enable emitting a sound proximal to the non-permeable panel;

a data portion, the data portion configured to enable transmission and storage of data; and a power source, the power source configured to provide power to at least one of the following: the liquid circulation apparatus, the lighting portion, the sound portion, the heating portion, and the filtering portion.

* * * * *